US005531325A

United States Patent [19]

Deflander et al.

[11] Patent Number: 5,531,325

[45] Date of Patent: Jul. 2, 1996

[54] STORING AND DISPENSING SYSTEM FOR PRODUCTS PACKED IN A SEALED POUCH

[75] Inventors: Joseph F. Deflander, Wespelaar; Robert De Caluwe, Londerzeel; Marielle J. C. Stulens, Hoegaarden, all of Belgium

[73] Assignee: The Procter & Gamble Company, Cincinnati, Ohio

[21] Appl. No.: 295,893

[22] PCT Filed: Mar. 5, 1993

[86] PCT No.: PCT/US93/01896

§ 371 Date: Oct. 31, 1994

§ 102(e) Date: Oct. 31, 1994

[87] PCT Pub. No.: WO93/17933

PCT Pub. Date: Sep. 16, 1993

[30] Foreign Application Priority Data

Mar. 13, 1992 [EP] European Pat. Off. ..... 92870043

[51] Int. Cl.[6] ..... B65D 85/16; A47K 10/20

[52] U.S. Cl. ..... 206/494; 206/813; 206/829; 221/46; 221/49; 221/64

[58] Field of Search ..... 206/494, 813, 206/829; 383/66, 203, 207, 209; 221/46, 49, 63, 64, 53, 54, 65

[56] References Cited

U.S. PATENT DOCUMENTS

| | | | |
|---|---|---|---|
| 2,018,271 | 10/1935 | Lewis . | |
| 2,854,134 | 9/1958 | Humphrey | 221/46 |
| 2,991,000 | 7/1961 | Spees . | |
| 3,002,674 | 10/1961 | Wright | 383/66 X |
| 3,197,062 | 7/1965 | Day et al. | 221/65 X |
| 3,456,844 | 7/1969 | Planner | 221/63 |
| 3,567,463 | 3/1971 | Williams . | |
| 3,784,055 | 1/1974 | Anderson | 221/46 |
| 3,918,608 | 11/1975 | Faller . | |
| 3,986,479 | 10/1976 | Bonk . | |
| 4,420,080 | 12/1983 | Nakamura | 206/449 |
| 4,458,810 | 7/1984 | Mahoney . | |
| 4,488,647 | 12/1984 | Davis . | |
| 4,552,269 | 11/1985 | Cheng | 383/66 X |
| 4,610,357 | 9/1986 | Nakamura | 383/207 X |
| 4,655,360 | 4/1987 | Juhanson . | |
| 4,674,635 | 6/1987 | Huldin et al. . | |
| 4,735,317 | 4/1988 | Sussman et al. | 206/494 X |
| 4,790,436 | 12/1988 | Nakamura . | |
| 4,840,270 | 6/1989 | Caputo et al. . | |
| 4,863,064 | 9/1989 | Dailey, III | 221/63 X |
| 4,871,093 | 10/1989 | Burshtain et al. | 221/64 X |
| 4,927,064 | 5/1990 | Burgin . | |
| 5,050,737 | 9/1991 | Joslyn et al. . | |
| 5,123,566 | 6/1992 | Lage et al. | 221/46 |
| 5,145,091 | 9/1992 | Meyers . | |

FOREIGN PATENT DOCUMENTS

| | | | |
|---|---|---|---|
| 0126362 | 11/1984 | European Pat. Off. | 221/65 |
| 2376802 | 12/1971 | France . | |

*Primary Examiner*—Bryon P. Gehman
*Attorney, Agent, or Firm*—Ronald W. Kock

[57] ABSTRACT

A storing and dispensing system for a product packed in a sealed pouch. The dispensing system includes a container of rigid material having a dispensing opening covered by a lid. The container is sufficiently air-tight in its closed condition to prevent free exchange of air between ambient and the inside of the container. A sealed pouch inside the container holds a product. The pouch has a pre-formed dispensing aperture which is sealed by a cover member adhesively attached to the pouch. The cover member is detachable from the pouch and removable through the container dispensing opening without damaging the pouch, and it is refastenable to the pouch. A glue strip attached to the pouch projects through a hole in the bottom of the container to prevent the container slipping on a supporting surface. The pouch has elastic members which cause it to contract as product is removed from the pouch.

4 Claims, 5 Drawing Sheets

STORING AND DISPENSING SYSTEM FOR PRODUCTS PACKED IN A SEALED POUCH

FIELD OF THE INVENTION

The invention relates to a storing and dispensing system for a product packed in a sealed pouch, the system comprising:

a container of relatively rigid material having a dispensing opening which is covered by a lid, the container being in its closed position sufficiently air-tight to prevent free exchange of air between the container's contents and the ambient, and a sealed pouch in which a product is contained, the pouch comprising a topface having opening means for manually opening the pouch, the pouch being after opening thereof storable inside the container, the opening means comprising a preformed dispensing aperture which is openably sealed by a cover member which is removable from the dispensing aperture.

BACKGROUND OF THE INVENTION

Such a system, wherein the pouch comprises pre-moistened tissues, is marketed by Scott Paper Co., Philadelphia, Pa. 19113, USA, under the trade name Baby Fresh.

In this system, a refill pouch made of laminated polyethylene film contains a folded stack of wet baby wipes. On a topface of the pouch, the film is provided with a line of weakening, the topface being covered by a glued-on tab that firmly adheres to the topface. To open the pouch, the tab is pulled so that the film of the pouch is ripped and the contents are exposed. To prevent the moist tissues from drying out, they can be taken from the pouch and placed inside a box-shaped plastic container. It is also possible to place the opened pouch inside the container as is shown in instructions on the pouch.

The above described refill system has as an advantage that by multiple use of the container, the waste coming from used-up product is reduced. Upon opening of the pouch however, the topface and the side face of the pouch are torn in a relatively irregular manner, so that the sides of the stack of tissues are exposed. Upon dispensing of the stack's topmost tissue from the container, the underlying tissues can accidentally be touched so that the hygienic conditions of those tissues deteriorates. Because the moist tissues can through the rip in the pouch contact the inside of the container, the container can in course of time be contaminated by the moisture of the tissues.

A storing and dispensing system containing a pouch which has a preformed dispensing aperture is known from the European patent application EP-A-0 370 192.

In this patent application a paperboard box is described for storage and dispensing of a stack of moist tissues. The paperboard box has a dispensing opening which is covered by a paperboard lid that can be opened along a pre-perforated line. The paperboard box is at its inside provided with a fluid-impervious layer of polyethylene, which is opened at the same time as the box is opened. In another embodiment, the paperboard box is provided with a liquid impervious, sealed, inner pouch in which the napkins are contained. The pouch is in the area of the dispensing opening of the box affixed to the inside of the box. The inner pouch can be opened by tearing loose a tab which remains at one end fixed to the pouch and which can be folded back over the pouch's aperture for reclosure.

The storing and dispensing system of this kind is not fit for multiple use, no refill being possible after the contents of the box have been used. Also is the recloseability of the known system limited since the tab of the pouch, that functions as a sealing lid after first time opening, rests on the peripheral edge of the dispensing aperture in a non-sealing manner.

In the French patent FR-A-2 376 802, a pouch containing moist tissues is disclosed, in which an oval shaped line of weakening is provided in the topface of the pouch. The topface of the pouch is covered by an adhesive label which upon removal tears the topface along the line weakening the pouch material which is stuck to the bottom of the adhesive label is removed from the pouch together with the label and a well-defined dispensing aperture is formed after opening. The pouch can be stored in a container.

OBJECTS OF THE INVENTION

It is an object of the invention to provide for a storage and dispensing system for products packed in a sealed pouch, wherein the amount of waste from used packaging material is reduced, which allows easy handling and in which hygienic conditions prevail.

It is another object of the invention to provide for a storage and dispensing system that allows for easy dispensing of the products from the pouch after placement inside the container and in which contamination of the container by the contents from the pouch, and vice versa, is prevented.

It is a further object of the invention to provide a storage and dispensing system in which the pouch after opening after first time use, can be easily transported without the container.

It is again another object of the invention to provide a storing and dispensing system which can be stably positioned and is suitable for being used single-handedly.

It is a still further object of the invention to provide a storing and dispensing system which is suitable for containing vacuum packed granular products.

SUMMARY OF THE INVENTION

A storing and dispensing system according to the invention is characterized in that the cover member can be completely detached from the pouch without substantially damaging the cover member or the pouch, the cover member comprising an adhesive adapted for adhesively refastening the cover member over the dispensing aperture subsequent to detachment of the cover member.

Because of the pre-formed dispensing aperture in the topface of the pouch, ripping of the pouch upon removal of the tab from the topface, is prevented. The clearly defined dispensing aperture, which can be formed by a cut in the pouch or by a line of weakening, does after opening not allow access to the tissues located underneath the topmost tissue. Since the pouch is, upon opening, not ripped in an arbitrary manner, the contents do not spill from the pouch upon placing of it in the container or upon dispensing product from the pouch when it is placed inside the container. This is especially important when the pouch contains a granular product such as ground coffee or detergent powder, which, in case the pouch is ripped upon opening, is easily spilled therefrom.

The cover member can after opening of the pouch be removed from the pouch's surface and can be attached to a receiving surface of the container. In this way the cover member's adhesive is protected from dust or other contamination. When the pouch is to be reclosed for transport, the cover member can be detached from the container's receiving surface and re-applied to the pouch. Transporting the pouch without the container is often convenient due to the better conformability of the pouch compared to the relatively rigid container. Also, if some of the contents from the pouch have been used, the pouch can be compressed to a smaller volume than the container.

After removal of the cover member from the pouch, it is advantageous to stick the cover member to the inside of the container's lid, so that each time upon opening of the container, the text or symbols of the label, which can comprise instructions for use, can be viewed by the user. It is important that the surface of the pouch to which the cover member is attached is of sufficient smoothness for the glue of the cover member to be easily released therefrom. The same applies for the container's surface to which the cover member is attached after removal from the pouch.

A glue suitable for use on the cover member is produced by MACtac Europe SA, Boulevard Kennedy 7060 Soignies, Belgium, under type number MR980. Especially when the pouch contains moistened tissues, such as wet baby wipes, it is desirable that the pouch can be transported without the container, which due to its rigidity often cannot very easily be handled during transport. By allowing the cover member to be removed from the container and re-fastened across the dispensing aperture, the storing and dispensing system according to the invention combines the advantages of a reclosable and easily transportable travel pack with the easy dispensing facility and good sealing properties of a container and its refill pack.

Another embodiment of a storing and dispensing system according to the invention is characterized in that the container is provided with an anti-slip support for exerting a force on the container for preventing movement of the container in a direction perpendicular and/or parallel to a supporting surface on which the container is placeable.

The anti-slip support can comprise a number of suction naps Velcro tapes or glue tapes engaging the supporting surface. It can also comprise a hole in the bottom of the container through which a part of the glue tape that is attached to the pouch, for restriction of movement of the pouch with respect to the container, can project and can contact the supporting surface. When the container is unable to move with respect to its supporting surface, both in a direction parallel and perpendicular to the supporting surface, the container can be opened and a tissue can be dispensed from the pouch by a user while only using one hand. Also the risk of tipping over the container when most of the tissues have been used, the container having at that time a reduced weight and reduced stability, is reduced when fixing the container to the supporting surface.

A further embodiment of a storing and dispensing system according to the invention is characterized in that the product contained in the pouch is of a granular nature.

It is known from EP-A-0 467 481 to pack granular detergents in a compact form, by packing the detergent in a pouch under vacuum, or by packing detergents in a heat shrinkable foil which is shrunk to compress the detergent. Another way of compact packaging of products, comprises packing the products in a pouch under compression. In a similar manner it is known to pack ground coffee in a pouch under vacuum.

It was found that for granular products, rather than pouring these products, after opening of the pouch, into the container, it is preferred to place the pouch containing the granular product inside the container. This will reduce the chance of spilling of product. Also, the sealing properties of the pouch will be partly maintained so that better protection of the product against drying out or loss of aroma is provided compared to when the pouch is absent. Providing a pre-formed dispensing aperture in the pouch containing granular products prevents the pouch from ripping in an arbitrary manner upon opening and reduces the chance of spilling of the granular products from the pouch into the container.

For granular products that are packed under vacuum, it is essential that an airtight seal is formed by the cover member overlying the dispensing aperture. For products that are packed under compression, the cover member must be sufficiently strong to adhere to the pouch without the expansion forces of the packed product detaching the cover member.

Again another embodiment of a storing and dispensing system according to the invention is characterized in that the pre-formed dispensing aperture comprises a peripheral edge, the dispensing aperture exclusively extending in the plane of one face of the pouch so that upon placing of the pouch in the container, the dispensing aperture is parallel with the dispensing opening, the peripheral edge of the dispensing aperture at most partly coinciding with a circumferential edge of the topface.

The dispensing aperture of the pouch is confined to lie in only one face of the pouch and is of smaller size than this face. When the pouch contains pre-moistened tissues, the pouch material of the topface surrounding the dispensing aperture covers the edges of the moist tissues that lie underneath this pouch material and restricts movement thereof. Upon pulling the topmost tissue from the stack through the dispensing aperture, the restriction of the tissues edges by the peripheral edge, cause the tissues to unfold from their flattened state. The edges of the topface surrounding the dispensing aperture prevent the sidefaces of the pouch from collapsing and prevent, in case the pouch contains a granular product, spilling of the granular contents into the container. The dispensing aperture is preferably elliptical, but can be round or rectangular.

Again another embodiment of a storing and dispensing system according to the invention is characterized in that the dispensing aperture is formed by a hole extending through the topface of the pouch or by an endless line of weakening, the dispensing aperture being covered by a tab of larger size than the dispensing aperture, the tab being connected to the pouch along the peripheral edge of the dispensing aperture.

The dispensing aperture of the pouch is before first time use covered by a sealing tab that can be glued over the dispensing aperture and that can be easily removed therefrom. Preferably a peeling force of the tab does not exceed between 0.8 and 1.2 N/cm. Useful materials for the tab comprise Polyvinyl chloride, polyethylene, polyethylene terephthalate, polypropylene and polystyrene, either as single layers or laminated in combination.

Again another embodiment of storing and dispensing system according to the invention is characterized in that the pouch comprises a laminate of at least two layers, an outer layer comprising the dispensing aperture, the inner layer being continuous and covering the dispensing aperture, the opening means comprising a tab that within the boundaries of the dispensing aperture is connected to the inner layer which is sufficiently thin to be torn upon removal of the tab from the dispensing aperture.

An airtight pouch that can be easily opened is made by forming the pouch's dispensing aperture in a first layer (that can for instance consist of aluminium) by pre-cutting a hole therein or by providing a pre-formed line of weakening, and by subsequently laminating a second layer (for instance polyethylene) with the first layer. In case a hole is pre-cut in the first layer, the second layer, which is before opening of the pouch a continuous layer, prevents contact of the contents of the pouch and the tab that is glued over the dispensing aperture for opening. Pouches of this kind are especially useful for containing aseptic products. A method for producing a laminate of two layers, one of which having a pre-cut aperture or a pre-formed line of weakening, is disclosed in the European patent application EP-A- 191525, which is incorporated herein by reference.

Another embodiment of a storing and dispensing system according to the invention is characterized in that the pouch comprises a laminate of at least two layers, an inner layer comprising the dispensing aperture which is formed by a hole extending through the inner layer or by an endless line of weakening, the dispensing aperture being covered by a tab of larger size, the tab being an integral part of the outer layer of the pouch and being formed by a cut or a line of weakening in the outer layer.

The inner layer prevents contact of moisture from the pouch's contents with the cut or the line Of weakening in the outer layer of the pouch. Especially if the pouch is made of a paper laminate, the inner layer prevents migration of liquid into the paper. Also, since the outer layer of the pouch functions as the label, a single printing step suffices for providing the outside of the pouch with instructions for opening and/or decorative printing. No extra printing of a separate label is necessary.

Again another embodiment of a storing and dispensing system according to the invention is characterized in that the pouch comprises a material which is stretched at least in a direction transversely to the pouch's dispensing aperture, so that, upon relaxation of the pouch when tissues are removed from it, the pouch's dispensing aperture retracts to lie substantially in the plane of the topmost tissue in the stack.

For easy dispensing of a tissue from a stack, it is desirable that the topmost tissue is located relatively close to the dispensing aperture. When the pouch is nearly empty, it is for pouches of larger size inconvenient for a consumer to have to reach inside the pouch through the dispensing aperture. By providing a pouch which is stretchable, for instance in a harmonica-like manner, and which contracts each time a tissue is dispensed from the pouch, the topmost tissue is located conveniently close to the dispensing aperture for both full pouches and for almost empty pouches.

Preferably the tissues are at their edges provided with a visual indication means for highlighting the edge with respect to the surface of the tissue. Hereby the ease of use of the tissues is increased. The visual indication means can consist of a color, an embossment or a cut pattern.

A further embodiment of a storage and dispensing system according to the invention is characterized in that the system comprises means for attaching the pouch to the container for preventing movement of the pouch towards the container's dispensing aperture.

The attachment means can be a tape which is with one side permanently fixed to the bottom of the pouch and which is at its other side provided with a glue that is strong enough to fix the pouch to the bottom of the container, but which can be torn loose from the container when the pouch is empty. A tape useful for fixing the pouch to the container is marketed by Tesa (Beiersdorf AG) under the tradename Tesafilm. The material of the pouch has to have a sufficient strength to prevent tearing upon removal of the empty pouch from the container. Another way of releasably fixing the pouch to the container is with a tape system (Velcro tapes) of which one tape is provided with flexible protrusions and which is stuck to the bottom of the pouch or the bottom of the container. A second tape is provided with hooks made of nylon or rayon fibers with which the protrusions engage. The second tape is fixed to either the pouch or the container, depending on where the tape having the protrusions is attached to. As an attachment means there could also be provided one or a number of suction naps which are preferably affixed to the bottom of the container and which engage with the smooth outer surface of the pouch.

BRIEF DESCRIPTION OF THE DRAWINGS

Some embodiments of storage and dispensing system according to the invention will be described in detail with reference to the accompanying drawings. In the drawings

DETAILED DESCRIPTION OF THE DRAWINGS

Although in the given examples the pouch contains a stack of pre-moistened tissues, the storing and dispensing system is not limited thereto and can contain in general all products that need to be sealingly packed before use, such as for instance ground coffee or detergent powders.

Figure 1:
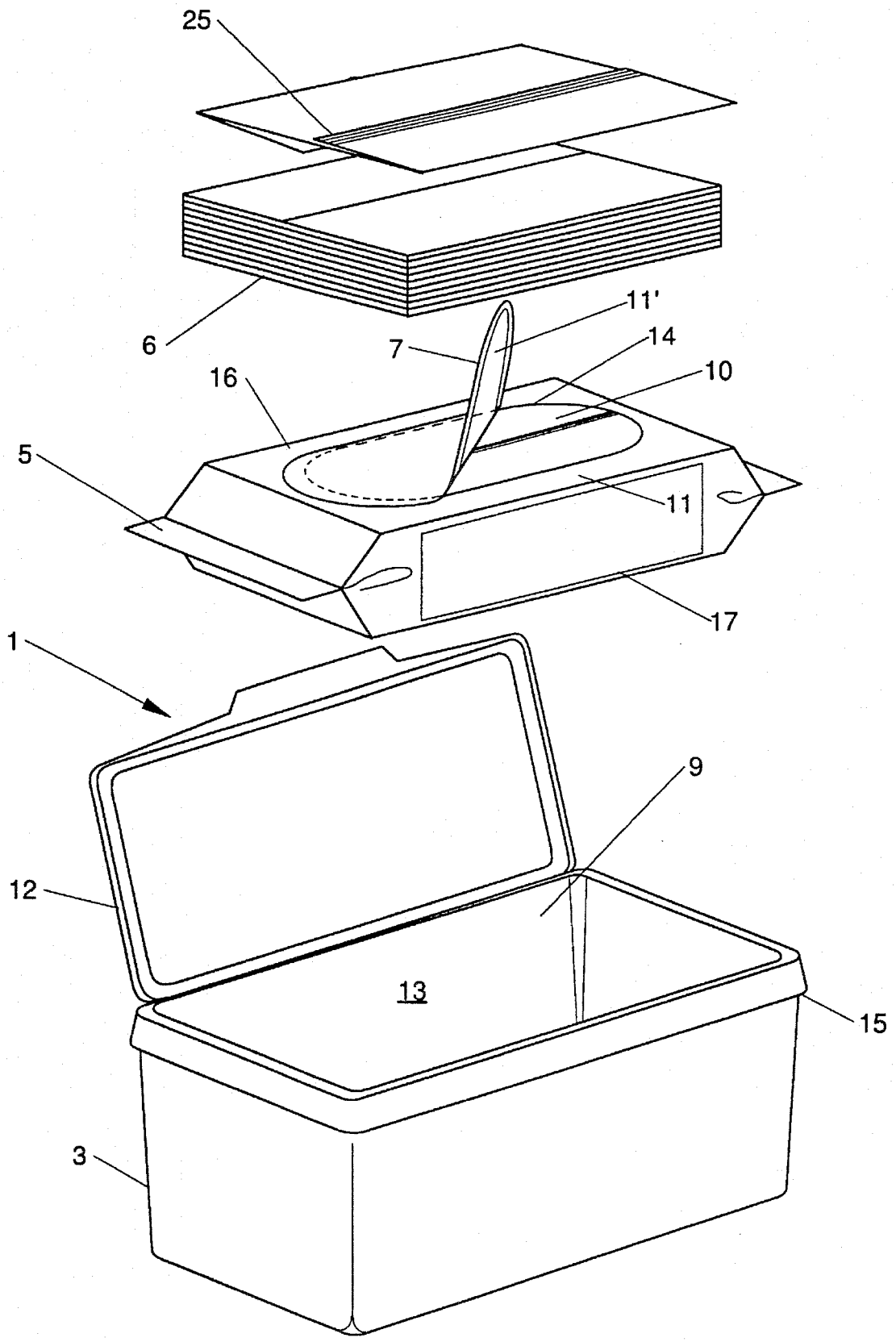
FIG. 1 shows a perspective view of a storing and dispensing system according to the invention.

FIG. 1 shows a storing and dispensing system 1 comprising a container 3 and a pouch 5. The pouch 5 contains a folded stack of pre-moistened tissues 6 and consists of a liquid impervious material. Laminates for use in the pouch 5 can include polyethylene terephthalate (PET), polyethylene (PE), polypropylene (PP), oriented polypropylene (OPP), aluminium (A1) and polyamide (PA) in the following combinations:

PET/PE, PET/PP, OPP/PP, PET/A1/PP, OPP/A1/PE, metallized OPP/PE, cellophane/PE, PA/PE and PA/PP. Useful paper-laminates include:

paper/PE, paper/PET/PE, paper/A1/PE, paper/A1/PP, OPP/paper/PE, OPP/paper/PP, PA/paper/PE, PA/paper/PP, cellophane/paper/PE, OPP/paper/A1/PE, OPP/paper/A1/PP, PET/paper/A1/PE, PET/paper/A1/PP.

The choice of laminates depends on the contents of the pouch and on the lifetime thereof.

The pouch 5 can be placed inside the container 3 through the container's dispensing opening 9 at the top. Before first time use the pouch 5 is sealed by a tab 7 which covers the pre-cut dispensing aperture 10. The part 11' that is cut out of the pouch's topface 11, preferably remains located between the tab 7 and the contents of the pouch 5. On first time use, the closed pouch can be placed inside the container 3 and the tab 7 can be removed from the dispensing aperture 10. The tab 7 is glued to the pouch by an adhesive, or is heat-sealed to the pouch, with a relative low peeling strength such as to be easily removable. Upon storage of the opened pouch 5 inside the container 3, the container 3 is closed by a lid 12. The lid 12 is connected to a sidewall 13 of the container and engages, upon closing, the sidewalls of the container so as to form a fluid-tight seal. For improved stability of the container's outer walls, they are at their end face provided with a rim 15 that also functions as a seal. The container 3 can be made of any fluid-impervious material such as laminated cardboard or a material such as, PVC, PP, PS, HDPE (high density polyethylene) or PET.

Since the pouch is stored inside the container 3, which in its closed state is fluid-tight and prevents drying out of the products contained in the pouch, the dispensing aperture 10 of the pouch can be relatively large and need not be reclosable. The tab 7 can in that case be removed completely from the pouch. Removal of the tab 7 from the pouch 5 allows for easy one-handed opening of the container 3 and dispensing of a tissue therefrom. Preferably the tab 7 is, after removal from the pouch, attachable to the inside of the lid 12 which forms a receiving surface. For easy re-attachment of the tab 7 to the pouch 5, it is preferred that the tab 7 overlaps the dispensing aperture 10 by a distance of at lease between 10 and 15 mm. A glue which is easily releasable from the pouch 7 and the lid 12 and which can be attached to the pouch repeatedly, is produced by MACtac S.A., Belgium. For good attachment, the inside of the lid 12 is smooth at least for a surface area equal to the surface area of the tab 7.

The dispensing aperture 10 preferably is of oval shape and is located in the topface 11 of the pouch 10, the peripheral edge 14 of the dispensing aperture being located within the peripheral edge 16 of the topface 11. Since the parts of the topface 11 located around the peripheral edge 14 restrain the edges of the topmost tissue in the pouch, this tissue is unfolded when pulled out of the pouch through the dispensing aperture 10. If a maximum protection against drying out of the tissue is desired, the dispensing aperture 10 can be in the form of a slit, although the ease of removing a tissue from the pouch in that case will be reduced.

For easy removal of the tissues from the pouch, it is, especially in the case of a smaller dispensing aperture 10, advantageous if the surface of the tissue is in the plane of the dispensing aperture or projects beyond this plane. Especially when little tissues are left in the pouch it can, in the case of a small dispensing aperture and a relatively large pouch, be hard to get them out. When the pouch is made of flexible material which is stretched around the tissues in a direction transverse to the dispensing aperture 10, the pouch will decrease in size when the tissues are removed from it. Thereby the uppermost tissue will remain in the plane of the dispensing aperture 10. The pouch 5 can be stretched around the tissues upon filling. In case the pouch itself is made of non-stretchable material, contraction of the pouch around the tissues can be obtained by connection of elastic members 17 along the sides of the pouch.

Figure 2:
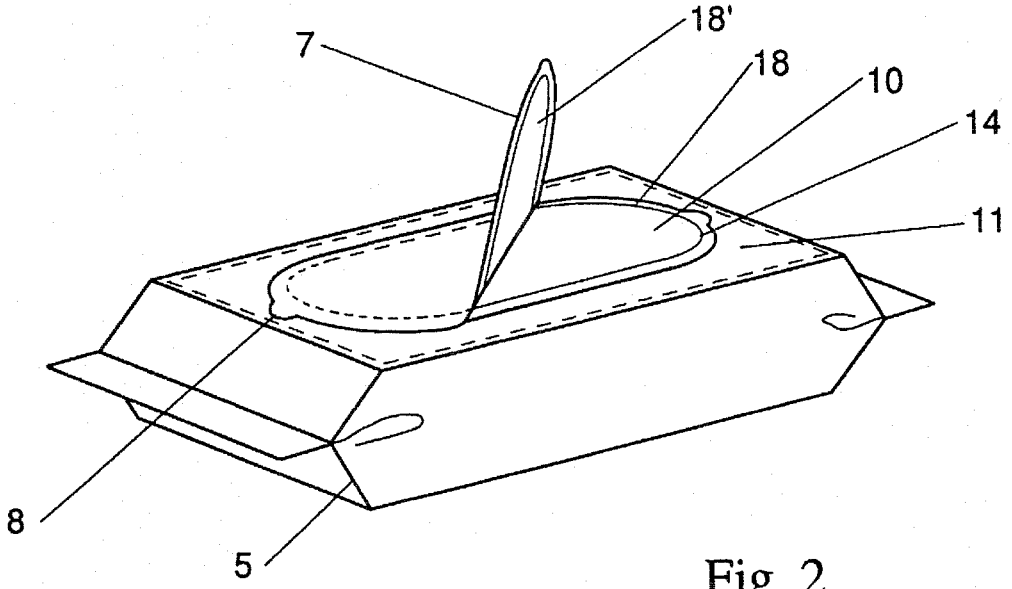
FIG. 2 shows a perspective view of a pouch comprising a laminate of two layers, the outer layer of the pouch forming the tab.
Figure 3:
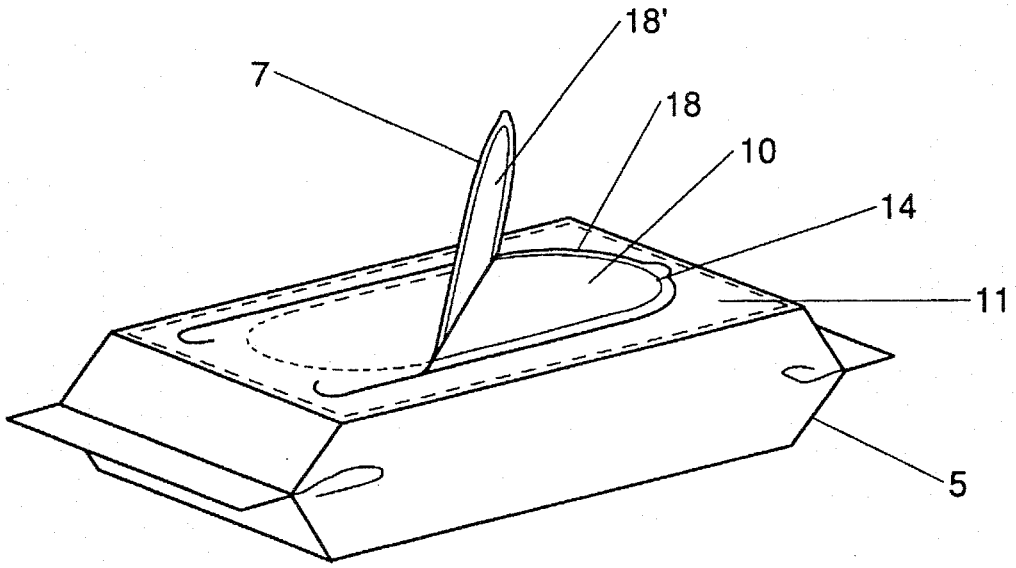
FIG. 3 shows a perspective view of a pouch as in FIG. 2, the tab being on one side connected to the topface of the pouch.

In the embodiment of FIGS. 2 and 3, the tab 7 is formed by the outer layer of the pouch. The tab 7 is cut-out in the pouch material and is glued to the inner layer 18 that is connected to the inside of the topface 11 of the pouch. The dispensing aperture 10 is pre-cut in the inner layer 18 along the peripheral edge 14, and is covered by the outer layer of the pouch and the part 18' of the layer 18. It is also possible that the layer 18 is a continuous layer that is laminated to all of the inside of the pouch 5 to form a gas-tight barrier. In this case, the dispensing aperture 10 is formed by the pre-cut hole in the outer layer of the pouch 5.

Preferably the tab 7 is at both ends provided with two protrusions 8 for easy opening by both right and left-handed users, without having to change the orientation of the pouch. The protrusions 8 are not glued to the layer 18. When placed inside the container 3, it is preferred that the edges of the topmost ply of the upper tissue in the stack of tissues in the pouch, always faces away from the user. It has been found that easiest dispensing occurs when a user can rest his fingers beyond the edge of the topmost tissue and can pull the tissue towards him. For this reason, the pouch will always be placed inside the container in a fixed orientation. After the sealed pouch 5 has been placed inside the container 3, a left-handed user will grab the tab 7 at its right-hand side and pull it to the left whereas the right-handed user will grab the tab at the left-hand side, both users finding an easy grip.

Figure 4:
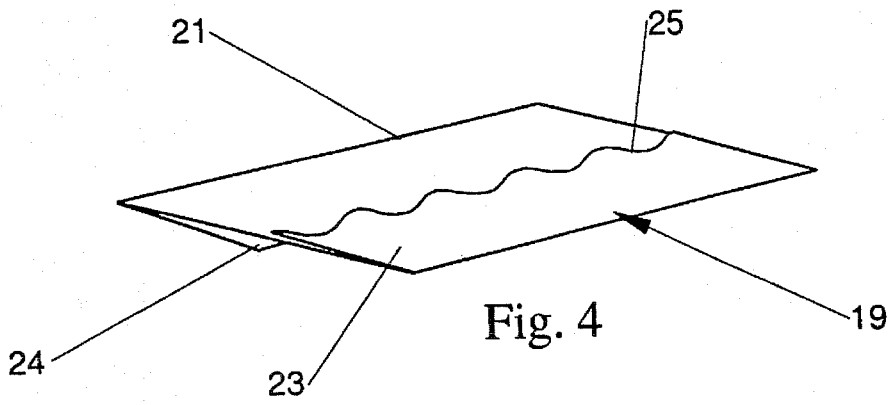
FIG. 4 shows a perspective view of a folded tissue having a non-straight edge as visual indication means.

FIG. 4 shows a tissue 19 which has been folded so that one side flap 23 is on top of a central part 21 of the tissue and one side flap 24 is underneath the central part 21. In order to increase the visibility of the edge 25 of the side flap 23 against the central part 21, it is provided with a non-straight cut pattern, such as for instance a curved pattern or a sawtooth pattern. Alternatively, the edge 25 of the tissue 19 can be embossed, for instance with a pattern of dots or stripes. Another way to highlight the edge is to give the straight cut edge, or the area next to it, a color which is contrasting with the central part 21, as indicated by the shaded area of the topmost tissue of the stack 6 in FIG. 1.

Figure 5:
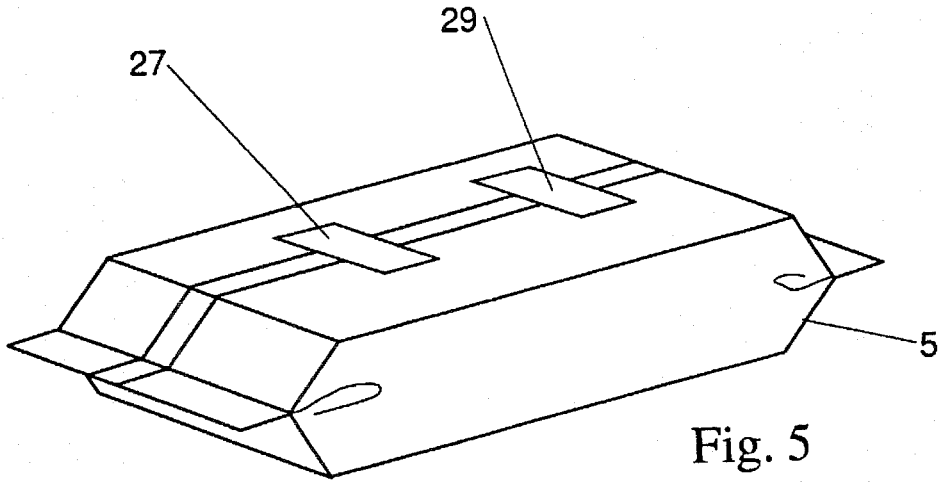
FIG. 5 shows a perspective view of the bottom of the pouch having as. attachment means a pair of glue tapes.

In FIG. 5, the attaching means for attaching the pouch to the bottom of the container comprise the glue tapes 27 and 29. The glue tapes 27 and 29 are double-sided and comprise a relatively strong glue at the side of attachment to the pouch. The side of the tapes which is to engage the bottom of the container 3, is covered with a glue that is strong enough to keep the pouch in place when tissues are pulled from the pouch 5. The side of the tape for engaging the bottom of the container is covered with a release paper, that is removed from the tape when the pouch is placed in the container upon refill. It is, depending on the material of the pouch, also possible to apply the glue for affixing the pouch to the container directly to the surface of the pouch 5, and to cover the glue by a release paper.

Figure 6:
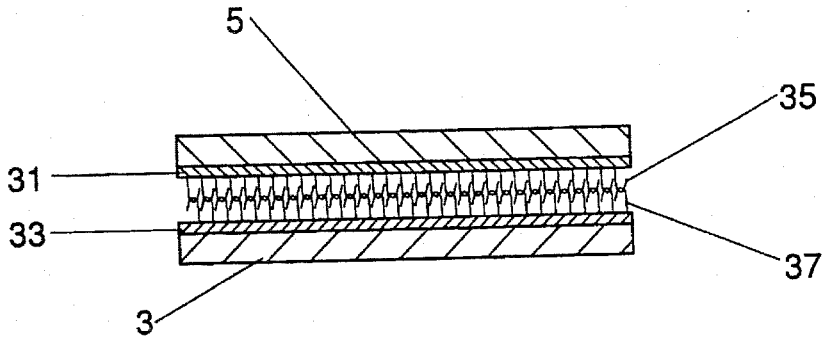
FIG. 6 shows a sectional view of the bottom of the pouch and the tub, the attachment means comprising hooks and complementary loops.

FIG. 6 shows alternative attachment means for affixing the pouch 5 to the container 3. The attachment means comprise a tape 31 which is glued to the bottom of the pouch 5 and which has a surface of protrusions 35. The hooks engage with loops 37 of a complementary tape 33 which is glued to the bottom of the container 3. Attachment means of the above mentioned kind are described in detail in the American Patent U.S. Pat. No. 5,058,247

Figure 7:
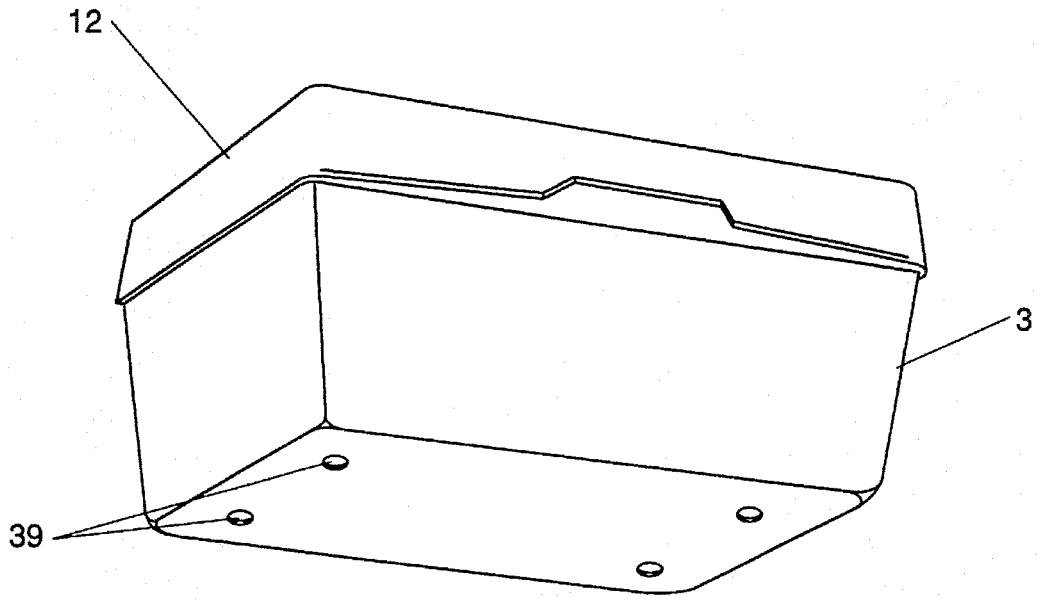
FIG. 7 shows a perspective view of the bottom of the tub, the anti-slip support comprising suction naps.

FIG. 7 shows a bottom view of the container, the anti-slip support comprising four suction naps 39 which can engage with a smooth and non-porous supporting surface of the container.

Because the container is prevented to move along the supporting surface or to be lifted therefrom, the container can be opened using one hand only. For instance when the tissues consist of baby wipes, it is important that one hand of the user of the tissues can remain available for holding the baby while with the other hand the container can be opened and a tissue can be taken from it.

Figure 8:
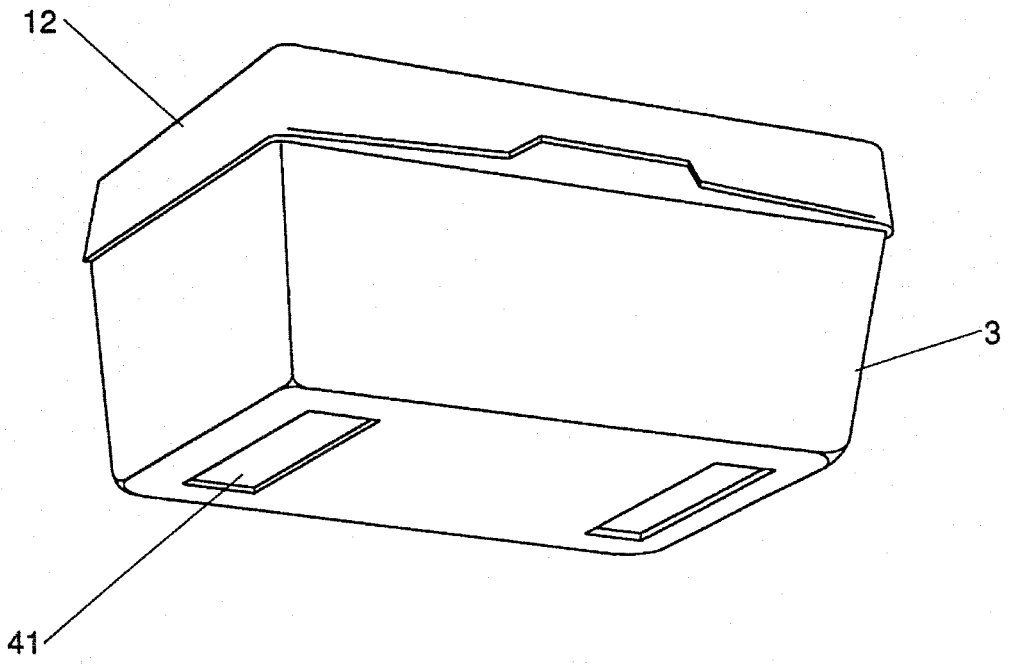
FIG. 8 shows a perspective view of the bottom of the tub, the anti-slip support comprising holes in the bottom of the tub.

FIG. 8 shows another embodiment of the anti-slip support. The container is provided with openings 41 in its bottom. Upon placing the pouch 5 in the container, the glue tapes 27 or the glued areas project through the holes and attach to the supporting surface of the container. In this way, the movement of the pouch with respect to the container and the movement of the container with respect to its supporting surface are prevented.

Figure 9:
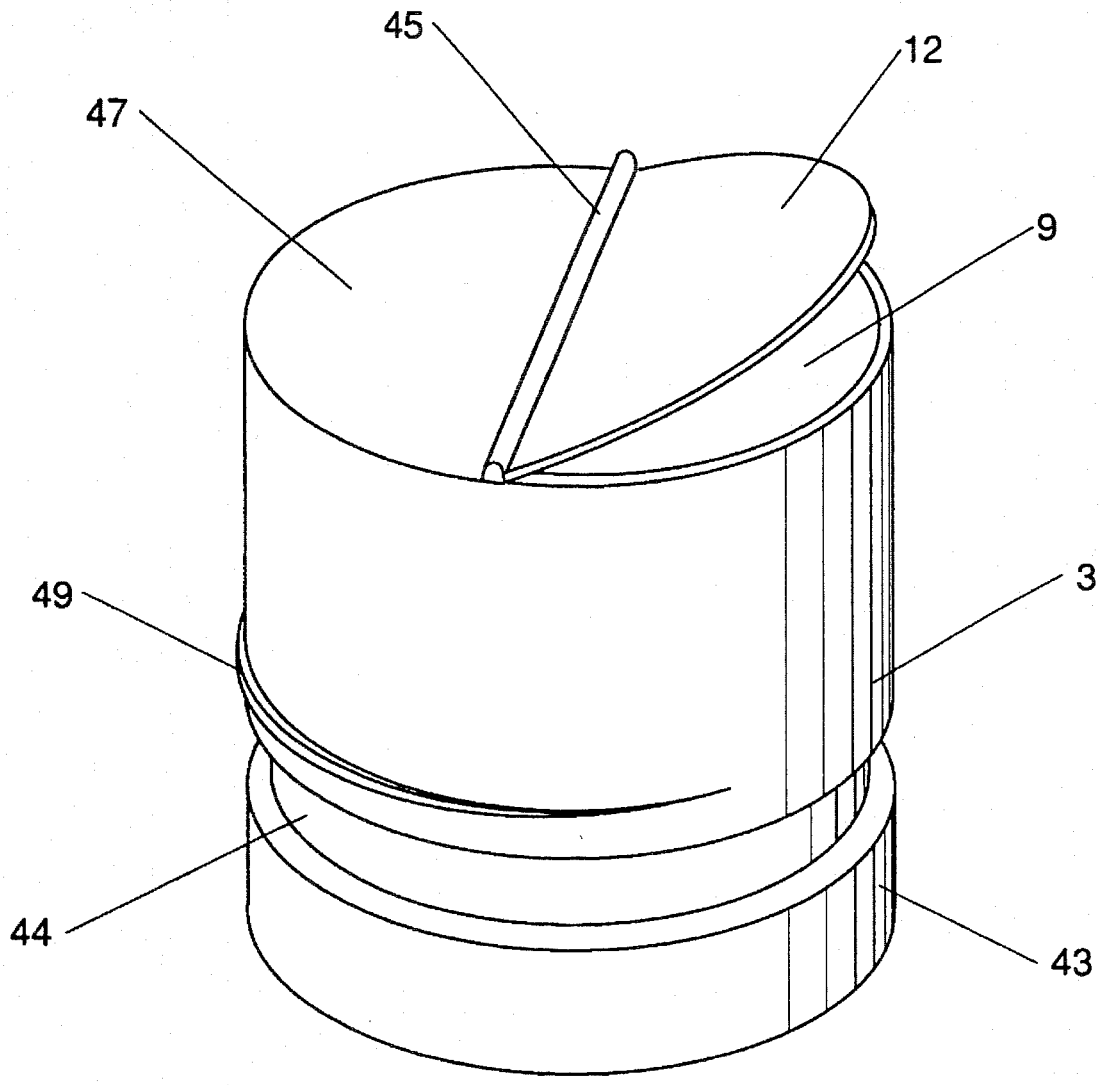
FIG. 9 shows a perspective view of a container having a separate refill and dispensing opening.

FIG. 9 shows a container 3 in the form of a flat cylinder. The bottom face of the cylinder forms the refill opening through which the pouch can be inserted. The refill opening is coverable by a lid 43. The lid 43 can be screwed on by engaging a screw thread 49 on the outside of the container with a groove, which is not shown in the drawing, on the inside of the lid 43. The topface 47 of the cylinder is provided with a lid 12 which is connected to the topface 47 along a hinge line 45. The lid 12 covers the dispensing aperture 9 of the cylinder.

We claim:

1. A storing and dispensing system for a product packed in a sealed pouch, the system comprising:

a) a rigid container having a dispensing opening covered by a lid, said container being in its closed position sufficiently air-tight to prevent free exchange of air between contents of said container and ambient air;

b) a sealed pouch containing a product, said pouch having a topface, said topface having an opening means for manually opening said pouch, said pouch being, after opening thereof, storable inside said container, said opening means having a pre-formed dispensing aperture sealed by a cover member, said cover member being removable from said dispensing aperture; and c) an anti-slip member for preventing movement of said container on a surface, said container having a bottom, said bottom having at least one hole therethrough, said anti-slip member being a glue strip projecting from said hole in said container and contacting said surface, said glue strip being attached to said pouch.

2. An anti-slip member preventing movement of a container on a surface, said container containing a pouch and having a bottom, said bottom having at least one hole therethrough, said anti-slip member comprising a glue strip projecting outward from said hole in said container and contacting said surface, said glue strip being attached to said pouch inside said container.

3. A storing and dispensing system for a stack of tissues packed in a sealed pouch, the system comprising:

a) a rigid container having a dispensing opening covered by a lid, said container in its closed position being sufficiently air-tight to prevent free exchange of air between contents of said container and ambient air;

b) a sealed pouch containing a stack of tissues, said pouch having a topface, said topface having an opening means for manually opening said pouch, said pouch being storable inside said container, said opening means having a pre-formed dispensing aperture sealed by a cover member, said cover member being removable from said dispensing aperture, said pouch comprising an elastic material which is stretched in a direction transverse to said dispensing aperture of said pouch, so that upon relaxation of said pouch when tissues are removed from it, said dispensing aperture retracts to lie substantially in a plane of a topmost tissue in said stack of tissues.

4. A storing and dispensing system for a stack of tissues packed in a sealed pouch, the system comprising:

a) a rigid container having a dispensing opening covered by a lid, said container in its closed position being sufficiently air-tight to prevent free exchange of air between contents of said container and ambient air;

b) a sealed pouch containing a stack of tissues, said pouch having a topface, said topface having an opening means for manually opening said pouch, said pouch being storable inside said container, said opening means having a pre-formed dispensing aperture sealed by a cover member, said cover member being removable from said dispensing aperture, said pouch comprising an elastic material which is stretched in a direction transverse to said dispensing aperture of said pouch, so that upon relaxation of said pouch when tissues are removed from it, said dispensing aperture retracts to lie substantially in a plane of a topmost tissue in said stack of tissues; and c) an anti-slip member for preventing movement of said container on a surface, said container having a bottom, said bottom having at least one hole therethrough, said anti-slip member being a glue strip projecting from said hole in said container and contacting said surface, said glue strip also being attached to said pouch.

* * * * *